US005111727A

United States Patent [19]

Rossum

[11] Patent Number: 5,111,727

[45] Date of Patent: May 12, 1992

[54] DIGITAL SAMPLING INSTRUMENT FOR DIGITAL AUDIO DATA

[75] Inventor: David P. Rossum, Aptos, Calif.

[73] Assignee: E-mu Systems, Inc., Scotts Valley, Calif.

[21] Appl. No.: 462,392

[22] Filed: Jan. 5, 1990

[51] Int. Cl.[5] ..... G10H 7/10; G10H 7/12

[52] U.S. Cl. ..... 84/603; 84/607; 84/608; 364/723; 364/728.01

[58] Field of Search ..... 84/601-608, 84/623, 659-661, 693, DIG. 9; 364/723, 724.1, 724.12, 728.01, 728.02

[56] References Cited

U.S. PATENT DOCUMENTS

| | | | |
|---|---|---|---|
| Re. 32,862 | 2/1989 | Wachi | 84/693 |
| 4,231,277 | 11/1980 | Wachi | 84/605 |
| 4,643,067 | 2/1987 | Deutsch | 84/607 |
| 4,715,257 | 12/1987 | Hoshiai et al. | 84/603 |

*Primary Examiner*—Stanley J. Witkowski

*Attorney, Agent, or Firm*—Heller, Ehrman, White and McAuliffe

[57] ABSTRACT

A digital sampling instrument for multi-channel interpolative playback of digital audio data stored in a waveform memory provides improved interpolation of musical sounds by using seven or eight surrounding points. The present invention may be efficiently implemented in a single VLSI circuit of low cost. The present invention allows a high channel count, providing many musical notes which can be played simultaneously, allowing them to be conveniently enveloped and mixed for performance in mono or stereo. The present invention allows timbral changes to the notes being played providing a musician with musical responsiveness. Also, the present invention accesses a waveform memory in an enhanced manner to allow improved performance parity between computational units and memory. Also, the present invention includes techniques which dramatically reduce the amount of memory required to store the musical waveforms while still maintaining adequate bandwidth and fidelity in the output.

10 Claims, 12 Drawing Sheets

TIME DOMAIN NOTCHED IMPULSE RESPONSE

FREQUENCY DOMAIN NOTCHED IMPULSE RESPONSE
(NOTCHES AT ARROWS)

TIME DOMAIN WINDOWED SINC FUNCTION

FREQUENCY DOMAIN WINDOWED SINC FUNCTION

TYPICAL SIGNAL : 60 SAMPLES IN MEMORY

CRITICALLY SAMPLED FOR DATA COMPRESSION

RECONSTRUCTED BY INTERPOLATION

DIGITAL SAMPLING INSTRUMENT FOR DIGITAL AUDIO DATA

BACKGROUND OF THE INVENTION

The present invention relates to an electronic musical instrument, and more particularly to a digital sampling instrument for sampling digital audio data representative of musical sounds.

To electronically simulate the complex musical arrangements produced by bands or orchestras, many different musical notes must be played simultaneously. Typically, these tones are either synthesized according to a mathematical formula, or recreated from digital recordings of musical instruments stored in memory. When the latter is done, each of the notes must be shifted in pitch from waveforms stored in memory.

If this pitch shifting is done by a system whose output is digitally sampled at a fixed sample rate, the process of pitch shifting is an interpolation process. The process of pitch shifting can be viewed as stepping through the waveform in memory with a variable step size which may have a fractional part. The fractional part of any step requires an appropriate interpolation of the surrounding digital samples to produce the correct output waveform point. The number of surrounding points taken into account by the interpolation process is known as the order of the interpolator. The present invention relates to moderate order multichannel interpolators used for the production of audio sounds and music.

Two approaches have been previously used for the interpolation process. The simpler is interpolation by line segment approximation, or "linear" interpolation. The other approach used for interpolation is termed "sinc function" or band-limited interpolation. In this approach, the points to be interpolated are convolved with a windowed sinc (sin(x)/x) function. Because the sinc function is the Fourier transform of a rectangular (or brickwall) function, the output of this interpolator approximates the curve of minimum high frequency energy through the interpolated points.

Both of these interpolation methods produce undesirable artifacts when used for pitch shifting. While the artifacts are minimized by adequately high order (15 points or more) bandlimited interpolation, it would be advantageous to provide an adequate interpolator of moderate order usable for pitch shifting of musical sounds.

SUMMARY OF THE INVENTION

It is an object of the present invention to provide improved interpolation of musical sounds by using seven or eight surrounding points. Additionally, the invention may be efficiently implemented in one preferred embodiment in a single VLSI circuit of low cost. A preferred embodiment allows a high channel count, providing many musical notes which can be played simultaneously, and also allows them to be conveniently enveloped and mixed for performance in mono or stereo.

In addition, a feature of the current invention allows timbral changes to the notes being played, providing the musician with musical responsiveness.

The invention further provides means by which the access time to the waveform memory can be enhanced to allow improved performance parity between the computational units and the memory.

Furthermore the current invention includes techniques which dramatically reduce the amount of memory required to store the musical waveforms while still maintaining adequate bandwidth and fidelity in the output.

Other objects, features and advantages of the present invention will be set forth in part in the description which follows and in part become apparent to those skilled in the art upon examination of the following or may be learned by practice of the invention. The objects and advantages of the invention may be realized and attained by means of the instrumentalities and combinations which are pointed out in the appended claims.

BRIEF DESCRIPTION OF THE DRAWINGS

The accompanying drawings which are incorporated in and form a part of this specification illustrate an embodiment of the invention and, together with the description, serve to explain the principles of the invention.

DETAILED DESCRIPTION OF THE PREFERRED EMBODIMENT

Figures 1A, 1B:
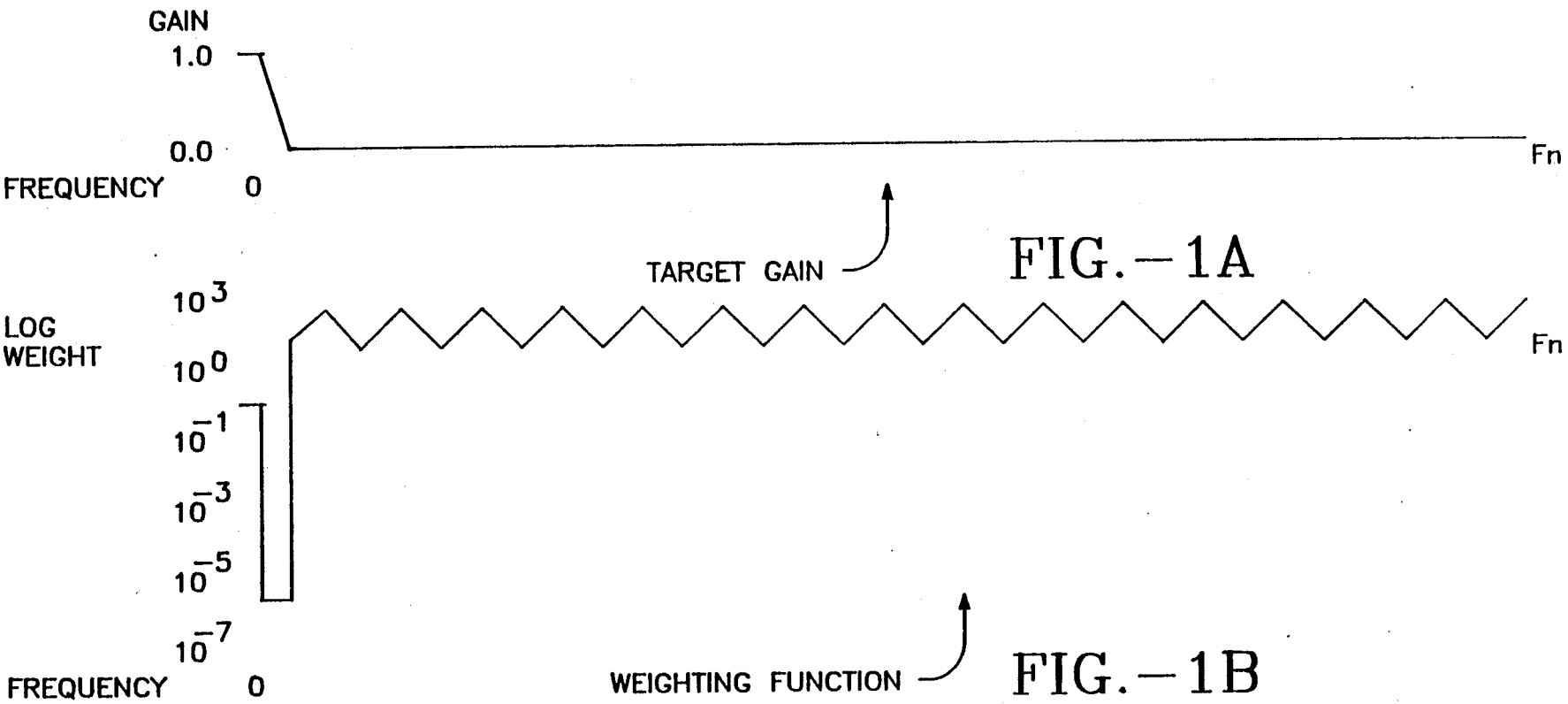
FIGS. 1A and 1B depict target gain and weighting functions, respectively, as utilized with the present invention.

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, it is intended to cover alternatives, modifications and equivalents as may be included within the spirit and scope of the invention as defined by the appended claims.

To pitch shift a signal stored in memory, using any form of interpolation, one begins with a current memory address consisting of an integer and a fractional part, produced from repeated addition of an increment value having an integer and fractional part, to a base address which corresponds to the location of the beginning of the sound in memory. One then convolves the memory samples located surrounding the current memory address with a set of coefficients which are a function of the fractional part of the memory address:

$$Y_{i+f}=X_{i-(n-1)/2}C_0(f)+X_{i-(n-3)/2}C_1(f)\ldots+X_iC_{(n-1)/2}(f)\ldots+X_{i+(n-1)/2}C_n(f)$$

where $Y_{i+f}$ is the output sample representing the signal at current address with interger part i and fractional part f, $X_m$ represents the original signal sample stored at address m, and $C_m(f)$ represents the mth coefficient which is a function of f. Note that the above equation represents an odd-ordered interpolator of order n, and that a similar equation represents an even-ordered interpolator.

For the current state of the art, a linear interpolator would be expressed as a second order interpolator (even, n=1), with $$C_0(f)=f$$

$$C_1(f)=1-f$$

The standard implementation method for a linear interpolator, due to the simplicity of the above equations, is to directly compute the output $Y_{i+f}$.

A sinc function interpolator of even order n would have coefficients:

$$C_{31\ n}=\sin((n-f)/pi)/((n-f)/pi)$$

$$C_{-n-1}=\sin(-f/pi)/(-f/pi)$$

$$C_0=\sin(f/pi)/(f/pi)$$

$$C_1=\sin((1+f)/pi)/((1+f)/pi)$$

$$C_n=\sin((n+f)/pi)/((n+f)/pi)$$

The traditional approach to implement a sinc function interpolation has been to store the above coefficients in a table in memory.

The present invention uses a similar approach as sinc function interpolation, but improves upon in in three ways. First, rather than using a sinc function or a windowed sinc function for the function stored in memory, the function stored in memory is a seventh or eighth order impulse response of a filter having deep (>90 dB down) notches at integral multiples of the sample rate and peaks only 60 dB to 70 dB down at half-integral multiples of the sample rate. Secondly, the impulse response is stored with only 112 or 128 points, and mirrored and linearly interpolated to provide a continuous function in f. Thirdly, a multitude of functions are stored to provide both for the shifting of pitch upward, and for the modulation of timbre of the sound for musical purposes.

Producing the impulse response for the filter can be done in a number of ways, but the preferred method involves the use of the Remez exchange algorithm. This algorithm is described in the literature, for example in "Digital Processing of Signals, 2nd Ed" by Maurice Bellanger (John Wiley & Sons, 1988). A target response of the form:

gain=1.0 for f=0 thru $f=f_c$ (passband), $gain=1.0(f_s-f)/(f_s-f_c)$ for $f=f_c$ thru $f=f_s$ (transition band), gain=0.0 for $f=f_s$ thru $f=f_n$ (stop band)

where $f_n$ is the Nyquist frequency, $f_s$ is the beginning of the stopband, and $f_c$ is varied to produce the several functions of different cutoff and timbre. A weighting function of the form:

weight=1.0 for f=0 thru $f=f_c*f_n$ (passband), weight=0.000001 for $f=f_c*f_n$ thru $f=f_s*f_n$ (transition band), weight=NSWT(PSWT/NSWT/$^{K(f)}$ for $f=f_s$ thru $f=f_n$ (stop band)

where

NSWT=the notch stop weight, typically about 2000,

PSWT=the peak stop weight, typically about 66, and

K(f) is a function periodic between the 16 notches, valued at:

K(f)=0.0 if f is within EPSILON of a notch, otherwise $K(f)=1.0+0.2log_2(f_{hinotch}-f)/(f_{hinotch}-f_{lonotch})$ if f is below a the peak and $K(f)=1.0+0.2log_2((f-f_{peak})/(f_{hinotch}-f_{peak}))$ if f is below a the peak and where $f_{hinotch}$ is the frequency of the notch at the high end, $f_{lonotch}$ is the frequency of the notch at the low end, $f_{peak}$ is the frequency of the peak at the center of the period, and EPSILON is the notch width, typically $f_n/512$.

These target and weighting functions are shown graphically in FIGS. 1A and 1B. A typical result is graphed in the time and frequency domain in FIGS. 2A and 2B. This can be compared with the equivalent sinc function responses in FIGS. 3A and 3B. The coefficients for the typical notched response is given in Table 1 below:

TABLE 1

| | | | | |
|---|---|---|---|---|
| −1.76482e-04 | −2.80411e-05 | −2.88158e-05 | −2.46347e-05 | −1.87968e-05 |
| −1.00873e-05 | 2.51618e-06 | 1.90793e-05 | 4.01338e-05 | 6.59547e-05 |
| 9.71765e-05 | 1.34006e-04 | 1.77026e-04 | 2.26064e-04 | 2.81886e-04 |
| 3.44148e-04 | 4.13468e-04 | 4.89258e-04 | 5.72071e-04 | 6.61072e-04 |
| 7.56578e-04 | 8.57506e-04 | 9.64024e-04 | 1.07495e-03 | 1.18975e-03 |
| 1.30705e-03 | 1.42666e-03 | 1.54694e-03 | 1.66723e-03 | 1.78384e-03 |
| 1.89538e-03 | 2.00823e-03 | 2.30703e-03 | 2.23996e-03 | 2.32145e-03 |
| 2.39336e-03 | 2.44830e-03 | 2.48535e-03 | 2.50154e-03 | 2.49661e-03 |
| 2.46781e-03 | 2.41417e-03 | 2.33337e-03 | 2.22505e-03 | 2.08762e-03 |
| 1.92109e-03 | 1.72439e-03 | 1.49820e-03 | 1.24225e-03 | 9.57995e-04 |
| 6.45892e-04 | 3.08346e-04 | −5.33297e-05 | −4.35900e-04 | −8.37246e-04 |
| −1.25316e-03 | −1.68040e-03 | −2.11401e-03 | −2.55058e-03 | −2.98432e-03 |
| −3.41064e-03 | −3.82117e-03 | −4.21098e-03 | −4.58223e-03 | −4.95827e-03 |
| −5.22598e-03 | −5.47788e-03 | −5.68381e-03 | −5.83258e-03 | −5.91962e-03 |
| −5.93834e-03 | −5.88508e-03 | −5.75447e-03 | −5.54262e-03 | −5.24526e-03 |
| −4.85995e-03 | −4.38396e-03 | −3.81608e-03 | −3.15493e-03 | −2.40097e-03 |
| −1.55455e-03 | −6.17815e-04 | 4.07193e-04 | 1.51650e-03 | 2.70624e-03 |
| 3.97084e-03 | 5.30482e-03 | 6.70091e-03 | 8.15169e-03 | 9.64852e-03 |
| 1.11835e-02 | 1.27465e-02 | 1.43280e-02 | 1.59146e-02 | 1.74941e-02 |
| 1.90737e-02 | 2.06358e-02 | 2.21342e-02 | 2.35951e-02 | 2.50015e-02 |
| 2.63387e-02 | 2.75974e-02 | 2.87672e-02 | 2.98404e-02 | 3.08081e-02 |
| 3.16629e-02 | 3.23978e-02 | 3.30073e-02 | 3.34864e-02 | 3.38315e-02 |

TABLE 1-continued

| | | | | |
|---|---|---|---|---|
| 3.40395e-02 | 3.41091e-02 | 3.40395e-02 | 3.38315e-02 | 3.34864e-02 |
| 3.30073e-02 | 3.23978e-02 | 3.16629e-02 | 3.08081e-02 | 2.98404e-02 |
| 2.87672e-02 | 2.75974e-02 | 2.63387e-02 | 2.50015e-02 | 2.35951e-02 |
| 2.21342e-02 | 2.06358e-02 | 1.90737e-02 | 1.74941e-02 | 1.59146e-02 |
| 1.43280e-02 | 1.27465e-02 | 1.11835e-02 | 9.64852e-03 | 8.15169e-03 |
| 6.70091e-03 | 5.30482e-03 | 3.97084e-03 | 2.70624e-03 | 1.51650e-03 |
| 4.07193e-04 | −6.17815e-04 | −1.55455e-03 | −2.40097e-03 | −3.15493e-03 |
| −3.81608e-03 | −4.38396e-03 | −4.85995e-03 | −5.24526e-03 | −5.54262e-03 |
| −5.75447e-03 | −5.88508e-03 | −5.93834e-03 | −5.91962e-03 | −5.83258e-03 |
| −5.68381e-03 | −5.47788e-03 | −5.22598e-03 | −4.95827e-03 | −4.58223e-03 |
| −4.21098e-03 | −3.82117e-03 | −3.41064e-03 | −2.98432e-03 | −2.55058e-03 |
| −2.11401e-03 | −1.68040e-03 | −1.25316e-03 | −8.37246e-04 | −4.35900e-04 |
| −5.33297e-05 | 3.08346e-04 | 6.45892e-04 | 9.57995e-04 | 1.24225e-03 |
| 1.49820e-03 | 1.72439e-03 | 1.92109e-03 | 2.08762e-03 | 2.22505e-03 |
| 2.33337e-03 | 2.41417e-03 | 2.46781e-03 | 2.49661e-03 | 2.50154e-03 |
| 2.48535e-03 | 2.44830e-03 | 2.39336e-03 | 2.32145e-03 | 2.23996e-03 |
| 2.30703e-03 | 2.00823e-03 | 1.89538e-03 | 1.78384e-03 | 1.66723e-03 |
| 1.54694e-03 | 1.42666e-03 | 1.30705e-03 | 1.18975e-03 | 1.07495e-03 |
| 9.64024e-04 | 8.57506e-04 | 7.56578e-04 | 6.61072e-04 | 5.72071e-04 |
| 4.89258e-04 | 4.13468e-04 | 3.44148e-04 | 2.81886e-04 | 2.26064e-04 |
| 1.77026e-04 | 1.34006e-04 | 9.71765e-05 | 6.59547e-05 | 4.01338e-05 |
| 1.90793e-05 | 2.51618e-06 | −1.00873e-05 | −1.87968e-05 | −2.46347e-05 |
| −2.88158e-05 | −2.80411e-05 | −1.76482e-04 | | |

Figure 4:
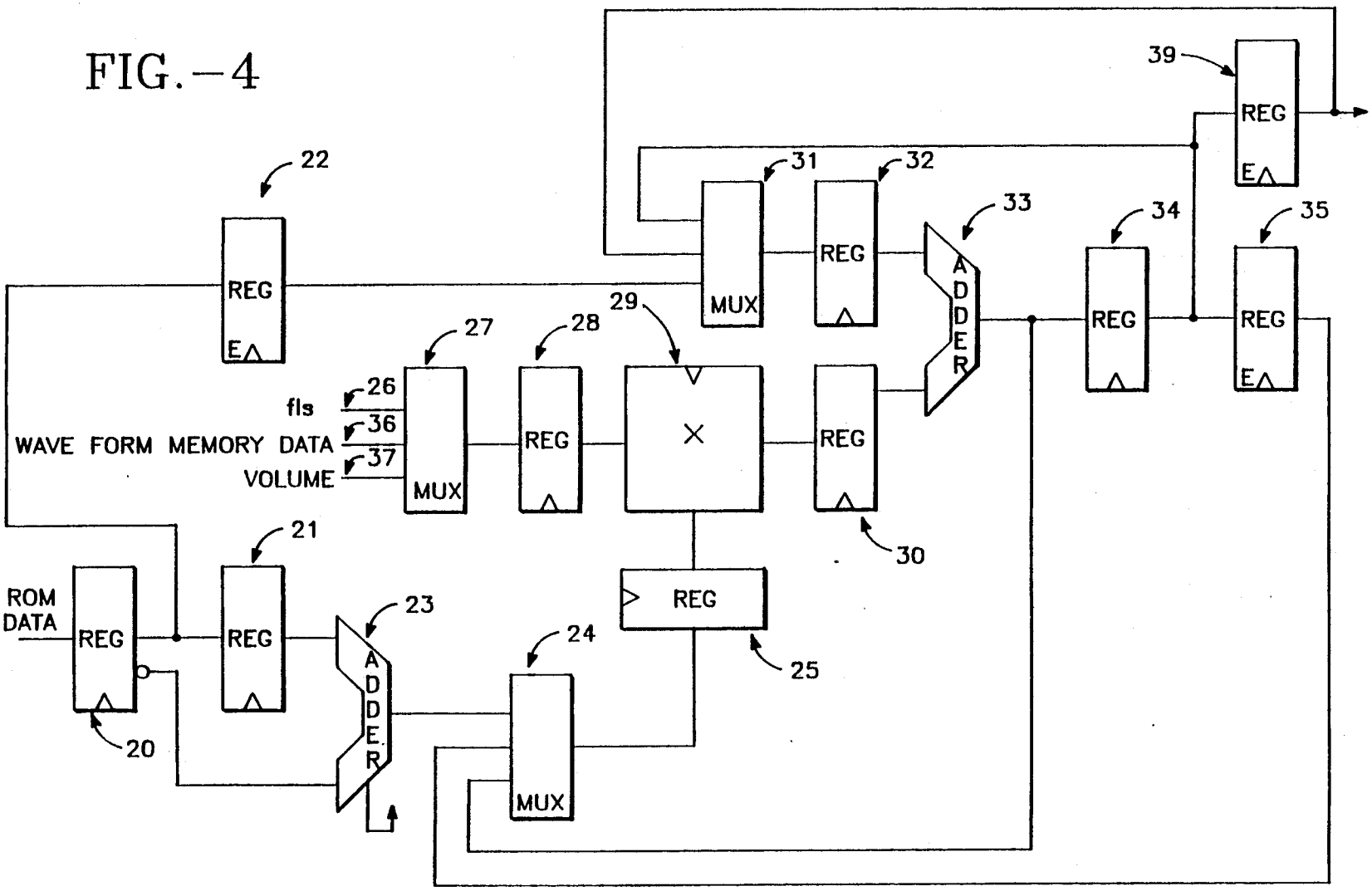
FIG. 4 depicts a preferred embodiment implementing a convolution according to the present invention.
Figure 5:
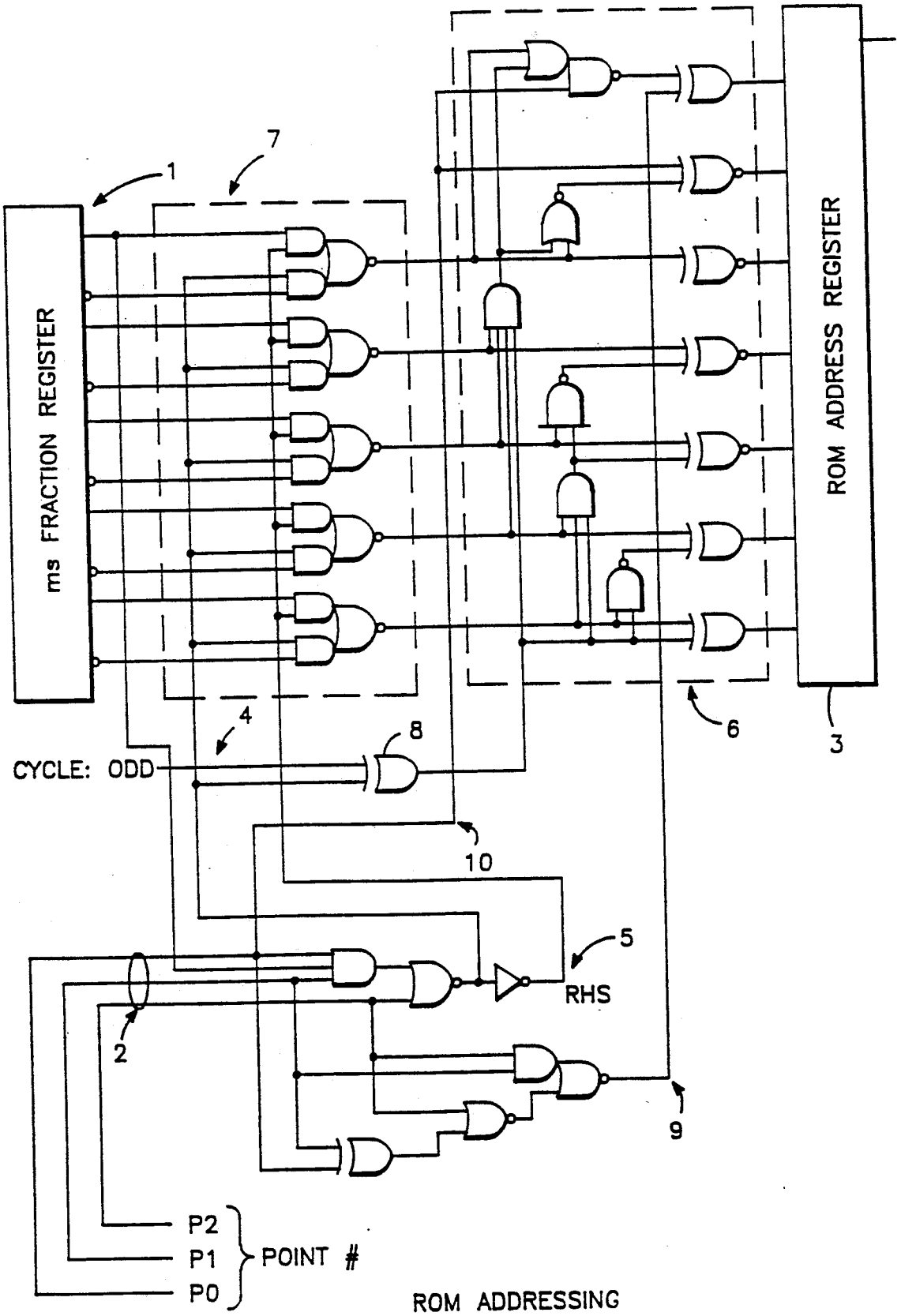
FIG. 5 depicts a diagram of ROM (read only memory) addressing utilized in the invention depicted in FIG. 4.
Figure 6A:
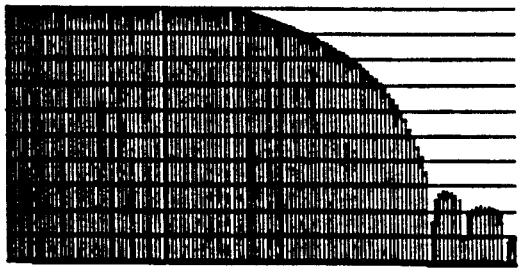
FIGS. 6A–F depict passband responses as utilized with the present invention.
Figure 6B:
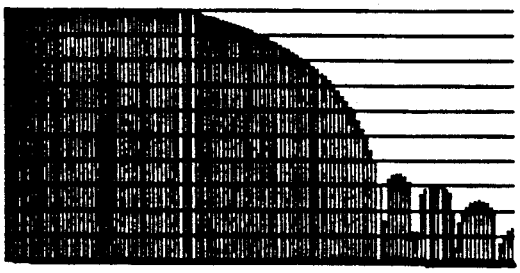
Figure 6C:
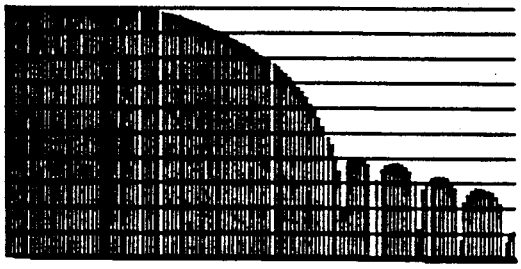
Figure 6D:
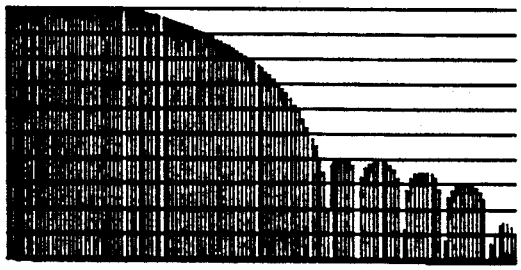
Figure 6E:
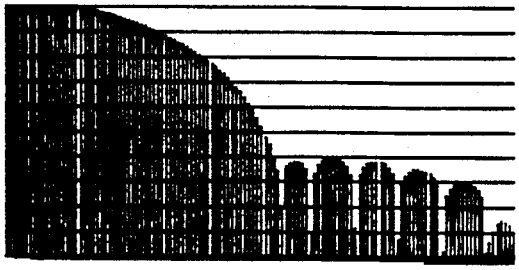
Figure 6F:
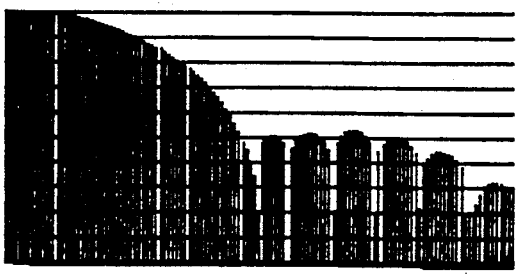

The actual implementation of the convolution is performed in the preferred embodiment as shown in FIG. 4, in sixteen successive cycles. The present invention optimizes the hardware by utilizing ROM memory in which the impulse response is stored efficiently by storing only 112 or 128 points. The coefficients are stored as a single side of the computed symmetrical response, and accessed using circuitry as shown in FIG. 5.

The ROM is accessed twice for each point of interpolation for 14 or 16 accesses per output point, and a linear interpolation of the ROM data based on the lower bits of the fractional part f provides the full coefficient $C_n(f)$. The linear interpolation of coefficients requires a single multiplication and additional per interpolation point, for a total of seven or eight multiplications and additions per output point. Similarly, the actual sum of products convolution requires a single multiplication and addition per interpolation point, for a total of seven or eight multiplications and additions to perform the convolution per output point. Since fourteen or sixteen cycles are necessary for the ROM, a shared adder and a shared multiplier provide full use of all of the hardware elements during each cycle for an efficient design.

A particularly useful additional operation for use in audio or music product is the scaling of the loudness of the final output point by an appropriate volume, and the summation of the multiple channels being interpolated to form a combined output. In the seven point case, the adder and multiplier can be used to perform these operations and still stay within the binary multiple sixteen cycles per point. If these operations are to be performed elsewhere, the eight point interpolation is slightly preferred for improved fidelity.

The operation of the present invention will now be explained in detail. Referring now to FIG. 5, to address the single-sided impulse response in the ROM, we must produce from the most significant part of the fraction (f) in the MS fraction register 1 and from the coefficient number n comprised of signals P0, P1 and P2 (2), a sequential pair of ROM addresses representing the base address and the next further (interpolating) address, the latter being multiplied by the least significant part of the fraction f in order to linearly interpolate the final coefficient n value. The base and interpolating ROM addresses will be stored in ROM address register 3 at the end of odd and even cycles, respectively. Signal ODD (4) in FIG. 5 indicates whether the cycle is even or odd.

Figure 2A:
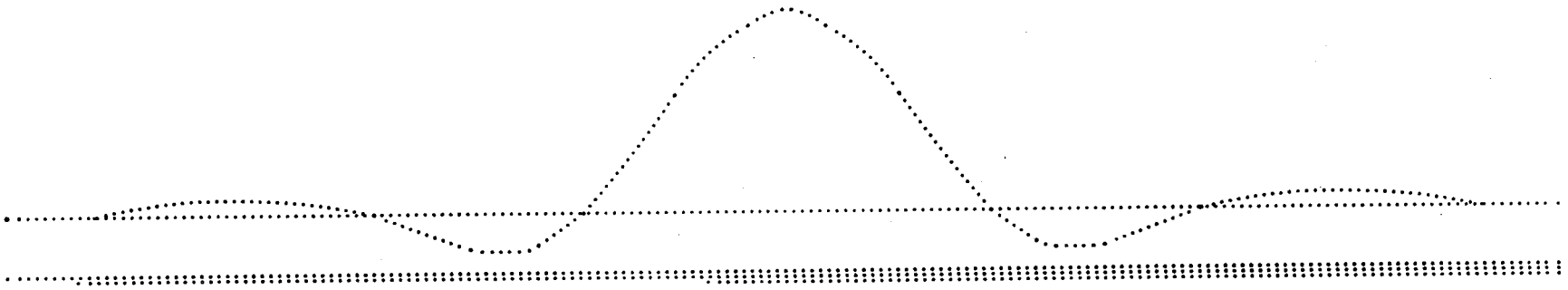
FIGS. 2A and 2B depict time domain and frequency domain notched impulse responses, respectively.
Figure 2B:
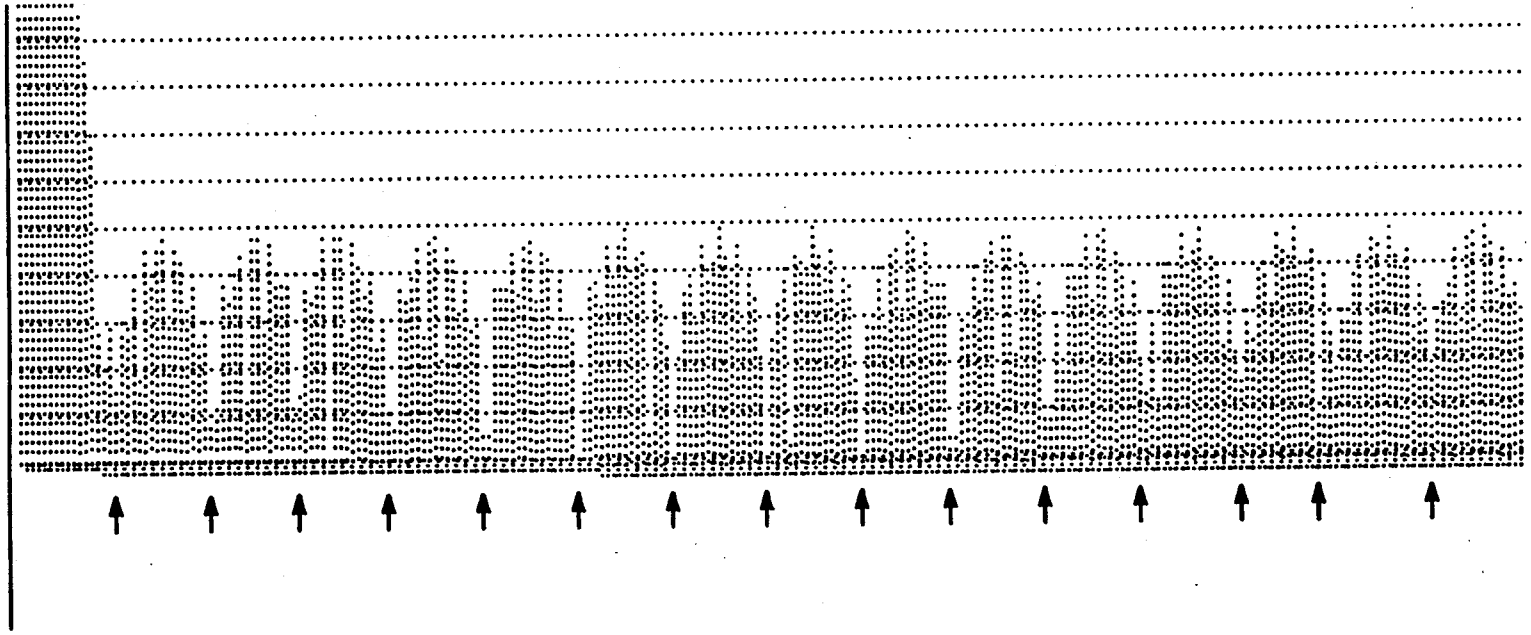
Figure 3A:
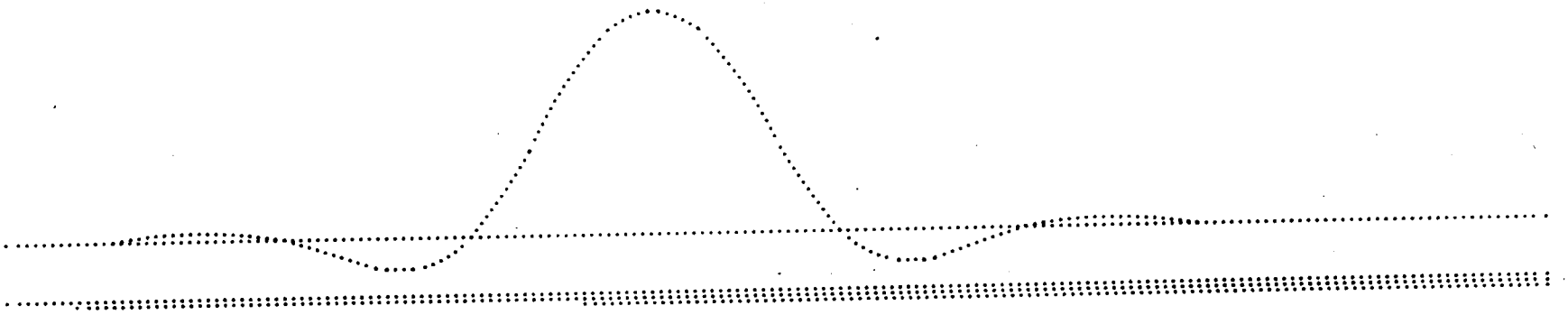
FIGS. 3A and 3B depict time domain and frequency domain window sinc functions, respectively.
Figure 3B:
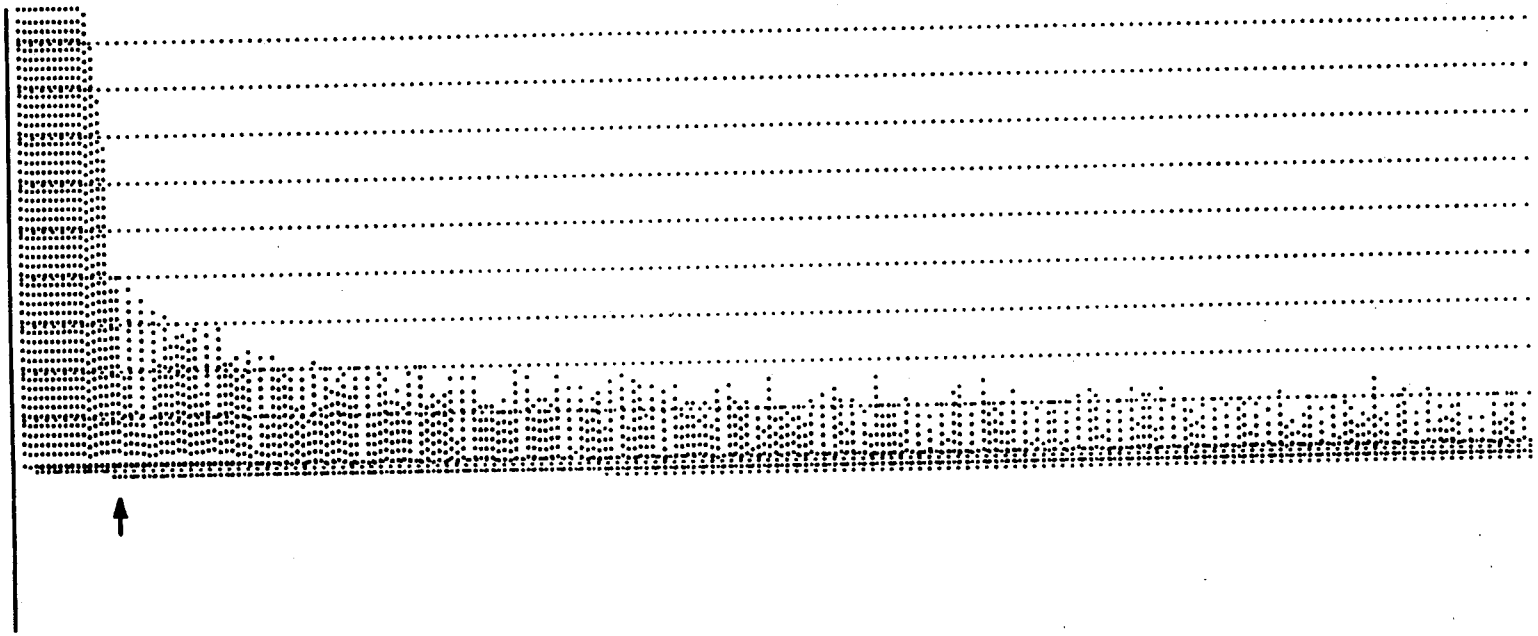

Viewing the entire impulse response as shown in FIG. 2A, the lower coefficients ($C_n(f)$ for small n) are on the left hand side of the curve, and the higher ones (large n) on the right hand curve. The center coefficient can be on either side. Each coefficient is spaced 32 locations away from the previous one, and as the fraction f increases the point on the curve used for the coefficient moves to the left. For a given fixed set of waveform memory samples, the fraction varies from ½ to just less than ½ of the following waveform memory address. This is accomplished by conceptually adding ½ to the effective waveform memory address address i+f. When this is done, the fraction f can be viewed as varying from zero to just below one while the same data in waveform memory are convolved with the coefficients $C_n(f)$. If the fraction f is zero, the base locations will be center−80, center−48, center, center+16, center+48, center+80, and center+112. At fraction f equals ½, the base ROM locations are center−96, . . . center, . . . center+96. As the fraction f increases to just below 1, the base locations tend towards center−111, . . . center−15, . . . center+81. The interpolation ROM addresses are always one further to the left.

If the impulse response is stored in the lowest 113 locations of ROM, with the center of the impulse response stored at location 0, one can locate the "zero fraction base addresses" (ZFBA) in the ROM for coefficients 0 through 6 at locations 80, 48, 16, 16, 48, 80, and 112. The associated interpolation addresses would be 81, 49, 17, 15, 47, 79, and 111. It can be seen that the base ROM address for a coefficient $C_n(f)$ on the left hand side of the impulse response would thus be $ZFBAn+f_{MS}$, and its interpolation ROM address would be $ZFBAn+f_{MS}+1$, while on the right hand side, the coresponding equations would be $ZFBAn-f_{MS}$ and $ZFBAn-f_{MS}-1$ respectively, where $f_{MS}$ is the five most significant bits of fraction f.

The circuitry to accomplish this math is realized by recognizing first that the coefficient will always be on the left hand side if its number n is 0, 1, or 2, and on the right hand size if n is 4, 5, or 6. Coefficient 3 will be on the left hand side if fraction f is ½ or greater. One should also note that the right hand side address equations can be re-written as ZFBAn+$f_{MS}$*+1 and ZFBAn+$f_{MS}$* respectively, where * denotes the one's complement.

Looking now at FIG. 5, one notes RHS signal 5 is high whenever the coefficient is on the right hand side of the impulse response, i.e. whenever P2 is high, or n=3 and the MS bit of the fraction is high. Logic network 7 selects fMS or its one's complement depending on whether the coefficient is on the right or left hand side of the impulse response. Logic network 6 is an adder, which adds 1 to the conditionally complemented fMS when the appropriate state of ODD and right hand side as determined by gate 8 is true. Adder 6 also adds the ZFBA, whose value is in binary 1010000, 0110000, 0010000, 0010000, 0110000, 1010000, and 1110000 for n from 0 to 6. Since only two bits of the above set change, the five unchanging bits are hard-wired into the adder 6, and the two changing bits are computed as signals 9 and 10.

Viewing now FIG. 4, the outputs of the coefficient ROM are latched in register 20, with the interpolating value valid during even cycles, and the base value on odd cycles. The value from the previous cycle is passed on to register 21, and on odd cycles when it is a base coefficient it is also latched in enabled register 22. Adder 23 acts as a subtractor to compute the difference between the base and interpolator coefficient ROM values, which will be valid during odd cycles. Multiplexer 24 selects adder 23's output during odd cycles, making multiplier input register 25 contain a coefficient difference during even cycles. Signal 26 is the least significant bits of the fraction f, which is selected by multiplexer 27 during odd cycles, causing multiplier input register 28 to contain the fraction during even cycles. Pipelined multiplier 29 takes two cycles to produce a product representing the value to be added to the base coefficient which is thus in product register 30 on even cycles. Multiplexer 31 selects base coefficient register 22 on odd cycles, causing register 32 to contain the base coefficient value on even cycles. Adder 33 thus adds the base coefficient value to the interpolating difference times the LS fraction during even cycles, and the resulting linearly interpolated impulse response value passes through multipexer 24 on even cycles to be stored in multiplier input register 25 on odd cycles. Multiplexer 27 selects waveform memory data 36 on even cycles, which is stored in multiplier input register 28 during odd cycles. Multiplier 29 forms the convolution product for this coefficient, and this product is contained in register 30 on odd cycles. Adder 33 serves to form the convolution sum on odd cycles, which is then stored in accumulator register 34 during even cycles, and passed through multiplexer 31 during even cycles to be ready for another convolution add by being valid in register 32 during odd cycles.

The convolution sum is originated by simply forcing multiplexer 31 to accept no inputs during the first even cycle of a sum of products computation, thus adding zero to the first product. Similarly, the final result is stored in enabled register 35, becoming valid during the odd cycle following the even cycle in which register 34 contains the final sum.

If only seven point interpolation is used, there will be one even and one odd cycle available for the arithmetic elements and associated latches if sixteen cycles per output point are used. In this case, multiplexer 24 can select data from final sum register 35 while multiplexer 27 selects volume data 37, thus allowing the multiplier to form the product of the output data point times the volume. Multiplexer 31 then selects the output of register 38 to be summed by adder 33 with the volume scaled data point, which causes register 34 to contain the sum of the volume scaled outputs of several channels. The result is then stored in enabled register 38. The sum is begun by causing multiplexer 31 to select no input for the first channel, and the output is transferred out from register 38 when all the desired channels are summed.

When audio is being shifted upward in pitch, the higher frequencies contained in the original sound would be shifted beyond the Nyquist frequency of the output sample rate, resulting in aliasing distortion. In this case, it is advantageous to select a filter with a primary cutoff below the original Nyquist frequency. The impulse response of filters with this characteristic are determined using the method above varying the $f_s$ and $f_c$ parameters. Typically a family of six filters might be chosen to span the possible band, with passband responses as shown in FIG. 6.

These filters would normally be utilized when the pitch is shifted upward, using filters with lower cutoff as the pitch is shifted upward by greater cutoff. However, in musical applications, it is often desirable to decrease the harmonic content of the sound being played to simulate a timbral difference. For example, if a piano note recording in waveform memory was produced by striking a key hard, playing it back through a filter of lower cutoff simulates a key that has been struck softly.

The present invention allows for this simulation at no additional cost by using the "wrong" filter for playback. As the filter choice is arbitrary and is selectable by simply addressing a different part of the coefficient ROM, a filter can be chosen depending on the hardness of the key pressed by the performer. This can then be used to simulate a softer key when desired.

Accesing waveform memory at adequate speed is problematical to implement the present invention. In particular, multipliers and adders are available today which can operate in approximately 40 nsec under worst case conditions. Large memories, such as dynamic RAM and mask ROM typically have cycle times today in the neighborhood of 200 nsec, and require signal buffering that further increases this value. Audio sample rates are typically 48 kHz. Simple arithmetic shows that in the sixteen cycle implementation of the current invention, 32 channels could be implemented. However, this would require a memory cycle time of 80 nsec. While improvements in semiconductor processing may improve these times, the ratios should not change dramatically, and hence the imbalance between channel processing time and memory cycle time will continue to be problematical.

Figure 7A:
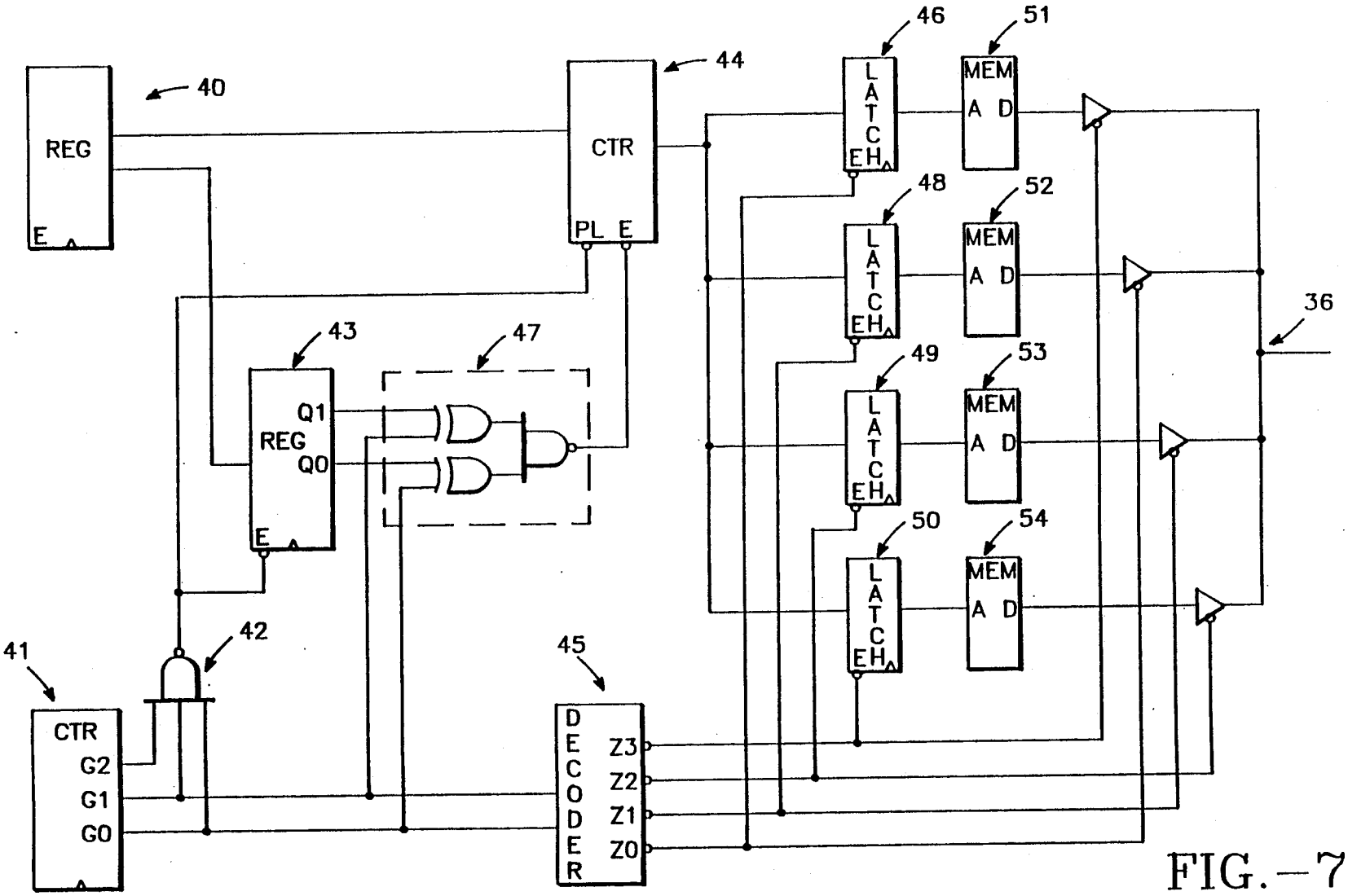
FIG. 7A depicts one preferred embodiment of single upward counter and logic according to the present invention.

The present invention provides for two solutions to the above dilemma. First, one can store each group of four adjacent points of the waveform in four separate memories. Due to the fact that the eight (or seven) points utilized in a given channel's computation must be adjacent in waveform memory, it is easily seen that this will require at most two accesses to each separate memory. The access cycles can be overlapped to provide the total memory cycle time required. A first preferred embodiment utilizes a single upward counter and logic as shown in FIG. 7A to implement the memory. Note that the memory is actually accessed backwards in time sequence, to allow for the use of an up counter, as any other implementation will require a more complex up-down counter.

A detailed description of the preferred embodiment of this first memory access means as shown in FIG. 7A follows. Enabled register 40 contains the full address of the lowest address in waveform memory to be accessed which will be valid at the appropriate time during the cycle; counter 41 counts the eight locations to be accessed. During access 7 of the previous channel, nand gate 42's output goes low, enabling both the loading of register 43 with the two least significant bits of the full memory address of the lowest point, and the parallel loading of enabled up counter 44 with the remaining most significant bits of the lowest point address. While counter 41's output is zero, decoder 45's ZO output is active, enabling memory bank 3's address latch 46, which will acquire the most significant part of the address from counter 44 at the end of this period. When counter 41's output becomes 1, counter 44 will be enabled to count up one count by logic 47 if and only if the 2 least significant bits of the lowest points address were equal to 3. Let us assume this is the case, in which case counter 44 will be incremented. During this period, memry bank 2's address latch 48 will be enabled, and will acquire the incremented MS address at the end of the period. Similarly, the next three periods will cause this same value to be acquired by memory bank 1's address latch 49, memory bank 0's address latch 50, and memory bank 3's latch 46. The period in which counter 41's output is equal to 4 will again cause logic 47 to increment counter 44 at the end of the period, causing memory address latch 50 to acquire a doubly incremented MS address at the appropriate time.

Figure 7B:
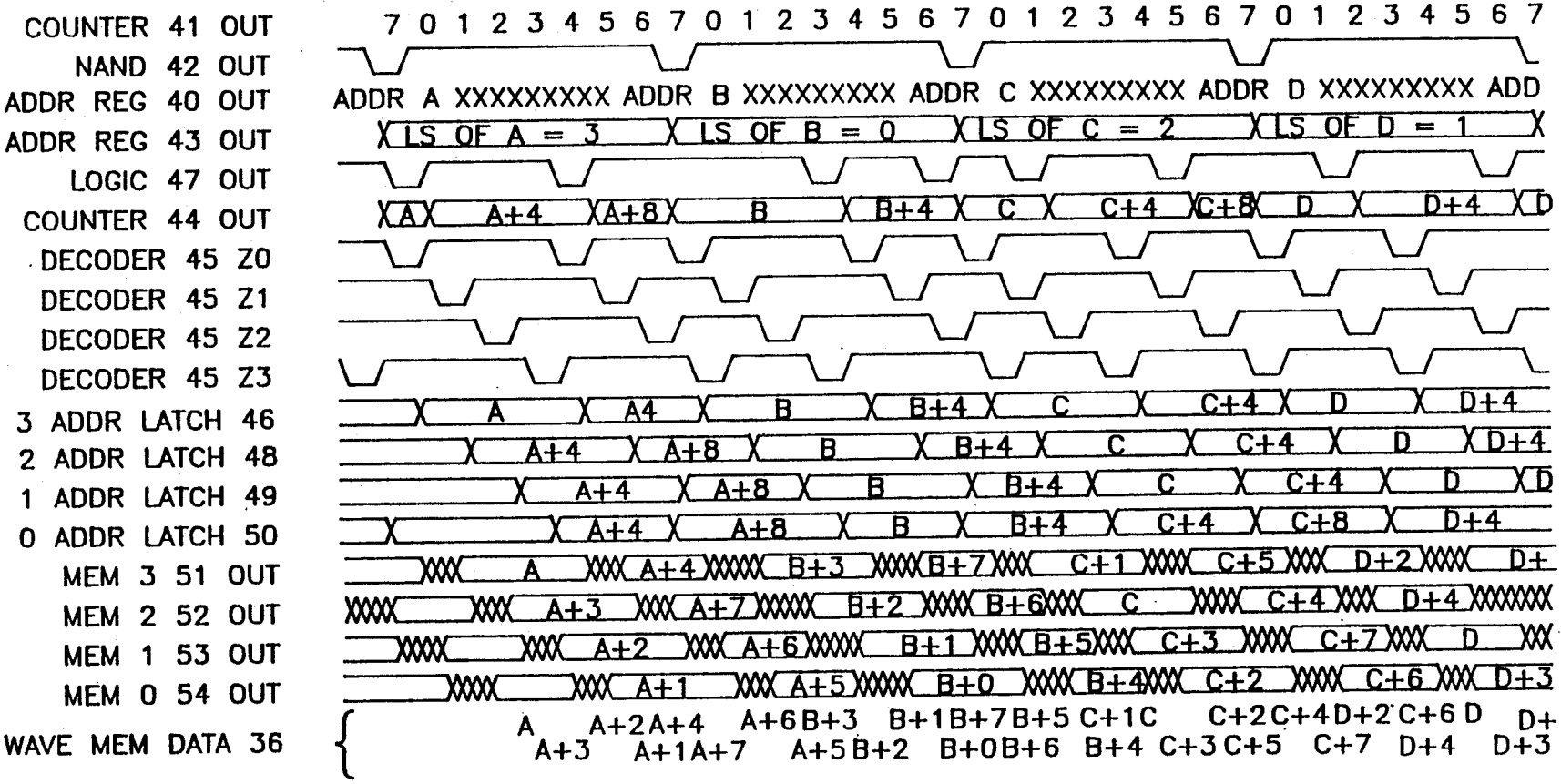
FIG. 7B depicts a timing diagram utilized with FIG. 7A.

Memories 51 through 54 are thus accessing data in parallel, which may take as long as three periods for the memory cycle. As a result, the output of memory bank 3 is enabled onto the waveform memory data lines 36 by output driver 55 during the third period after the address has become valid. The sequence is illustrated in the timing diagram of FIG. 7B.

It will be noted that the waveform memory data bus will contain the required data points, but not in the expected order of lowest, next, etc., to highest. This is easily corrected by modifying the coefficient number signals P0, P1, and P2 to the coresponding order.

A second solution to the memory access problem depends on the fact that in most cases, pitch shifting upward will be done to a degree less than three octaves. In such cases, some of the points used by the previous computation of an output point will also be used by the current point. In this cases, the use of a temporary or cache memory allows a decrease in the number of memory cycles required, thus compensating for the slow speed of memory.

Figure 8:
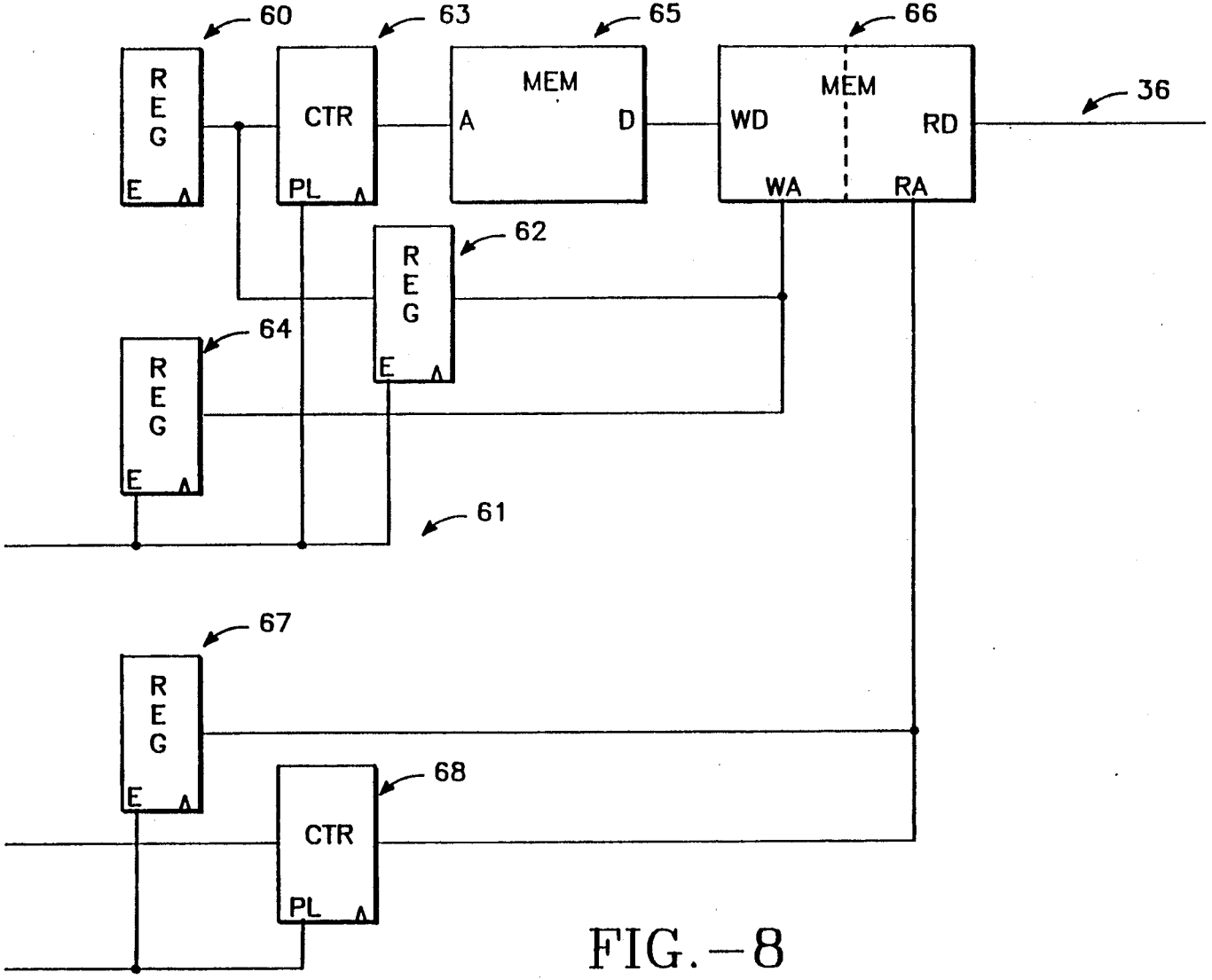
FIG. 8 depicts another preferred embodiment of the present invention.

A preferred second embodiment shown in FIG. 8 demonstrates this technique. Enabled register 60 is loaded at an appropriate time with the highest waveform memory address required. Signal 61 loads down counter 63 with the address from register 60, loads register 62 with the least significant 3 bits of the address from register 60, and loads register 64 with the channel number being processed by the memory access unit. For each required new data point, the number of which is the integer part of the increment (which was added to the address), an access is made to sound waveform memory 65, and the address is counter 63 is decremented by one. The resulting sound waveform data is then stored in cache memory 66 at an address which is the concatenation of the LS three bits of the waveform memory address stored in register 62 with the channel number stored in register 64.

Asynchronously, the convolution portion of the circuitry retreives data from the cache memory 66. The read data corresponding to the appropriate impulse response coefficient is placed on sound waveform data bus 36 by forming the proper memory read address, which is the concatenation of the point number and the convolution logic channel number. The convolution channel number is stored in enabled register 67 at the beginning of the channel processing cycle, and 3 bit down counter 68 is loaded with the least 3 significant bits of the highest waveform memory address to be accessed for this channel. Note that the coefficients are now required in reverse order, and signals P0, P1, and P2 count from seven to zero.

As mentioned above, typically the required pitch shifting according to the current invention is downward, or upward less than three octaves. This is due to the fact that the current invention allows for substantial data compression by means of sample rate conversion.

Figure 9A:
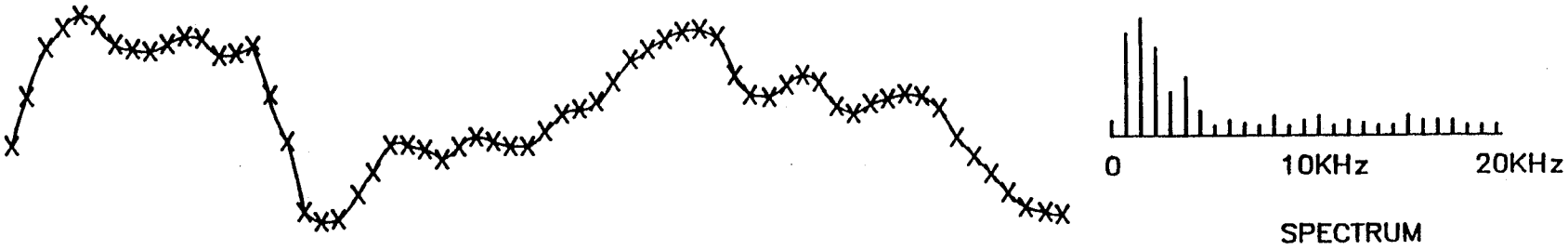
FIGS. 9A–9C depict an example of a typical note waveform as utilized with the present invention.
Figure 9B:
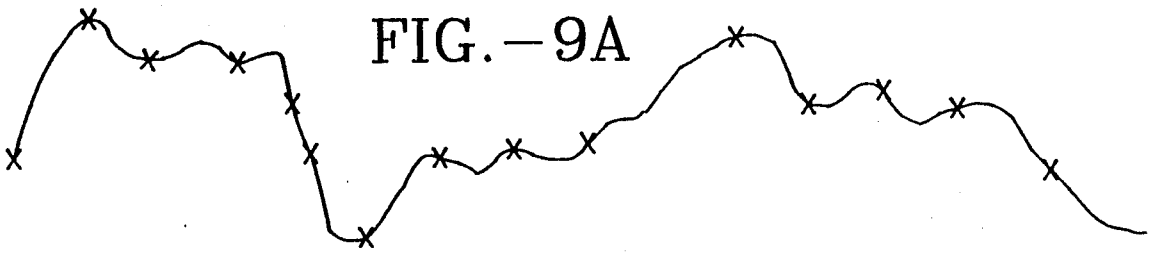
Figure 9C:
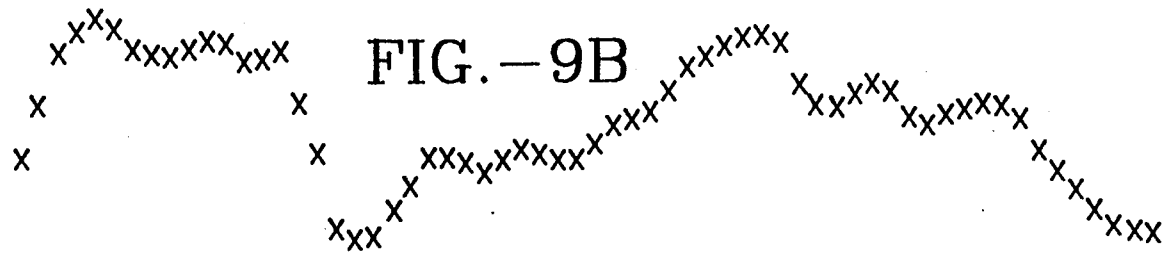

Due to the fact that the interpolator is of adequate audio quality, musical waveforms can be "critically sampled" by perfroming a pre-computed sample rate conversion down to what has been audibly determined to be twice the highest frequency of significance in the note in question. For example, a typical piano note waveform taken from middle C has been empirically determined to require a sample rate in the neighborhood of 12 kHz, which implies that the highest frequency of interest is 6 kHz. This is shown in FIG. 9. As a result, storing this note requires only one fourth the amount of memory normally required to store such a note at the output sample rate of 48 kHz. Yet the reproduction will be performed such that the available output bandwidth is 48 kHz, and when the note is to be pitch shifted upward by as much as a factor of four, this bandwidth will be utilized.

Looking more carefully, one will see that in fact by sample rate converting the signal to 12 kHz sample rate, the pitch shifting upward by a factor of four has already been done, and that playing back the sample at the original pitch of middle C will in fact be accomplished when the interpolator is programmed to shift pitch downward by two octaves. Thus, by the use of sample rate conversion data compression, it will be seen that the requirements for the interpolator to shift pitch upward have been essentially eliminated.

The foregoing description of the preferred embodiment has been presented for purposes of illustration and description. It is not intended to be exhaustive or to limit the invention to the precise form disclosed, and many modifications and variations are possible in light of the above teaching. The preferred embodiment was chosen and described in order to best explain the principles of the invention and its practical applications to thereby enable others skilled in the art to best utilize the invention and its various embodiments and with various modifications as are suited to the particular use contemplated. It is intended that the scope of the invention be defined only the claims appended hereto.

What is claimed is:

1. A digital sampling instrument operating at a certain sampling frequency for the multichannel interpolative playback of digital audio data stored in a waveform memory comprising:

low pass coefficient memory means for storing one or more impulse responses whose corresponding spectra have notches at multiples of said sampling frequency which are of a different value than the remainder of said spectra, convolution means for computing a sum of products of the contents of said coefficient memory means times the contents of said waveform memory for each of several output channels to form a convolution, means for outputting the result of said convolution for each of said channels.

2. An instrument as in claim 1 where said impulse response is computed by use of a Remez exchange algorithm.

3. An instrument as in claim 1 wherein the number of products in said convolution is seven or eight.

4. A digital sampling instrument operating at a certain sampling frequency for the multichannel interpolative playback of digital audio data stored in a waveform memory comprising:

coefficient memory means for storing one or more impulse responses, linear interpolation means including multiplication means for computing the product of the difference between adjacent points in said coefficient memory means times the least significant portion of a fractional address, said linear interpolation means further including addition means for adding said product to one of said points in said coefficient memory means, convolution means for computing a sum of products of the contents of said coefficient memory means times the contents of said waveform memory for each of several output channels to form a convolution wherein said convolution means include the same multiplication and addition means as said linear interpolation means, and means for outputting the result of said convolution for each of said channels.

5. An instrument as in claim 4 wherein said impulse response corresponds to a spectrum having notches at multiples of the sampling frequency.

6. An instrument as in claim 5 where said impulse response has been computed by use of a Remez exchange algorithm.

7. An instrument as in claim 4 wherein the number of products in said convolution is seven or eight.

8. A digital sampling instrument as in claim 4 including coefficient memory means for storing several impulse responses, means for selecting which of said several impulse responses will be used for a particular musical note in a particular channel depending on the emphasis with which said particular note should be played, convolution means for computing a sum of products of the contents of said waveform memory times said selected impulse response waveform in said coefficient memory for each of several output channels, means for outputting the result of said convolution for each of said channels.

9. A digital sampling instrument for the multi-channel interpolative playback of digital audio data stored in a waveform memory means comprising:

coefficient memory means for storing several impulse responses, said waveform memory means comprising four banks of memory such that adjacent samples are stored n differing banks, output multiplexing means for forming a multiplexed output of said four banks of memory such that the output of the highest order bank is output first and so on until the lowest order bank is output last.

means for selecting an impulse response waveform, convolution means for computing a sum of products of the contents of said waveform memory means times said selected impulse response waveform in said coefficient memory means for each of several output channels to form a convolution, means for outputting the result of said convolution for each of said channels.

10. A digital sampling instrument for the multichannel Nth order interpolative playback of digital audio data stored in a waveform memory comprising:

coefficient memory means for storing several impulse responses, cache memory means for storing N waveform memory samples for each channel, means for selecting an impulse response waveform, convolution means for computing a sum of N products of the contents of said waveform memory times said selected impulse response waveform in said coefficient memory for each of several output channels to form a convolution, and means for outputting the result of said convolution for each of said channels.

* * * * *